United States Patent [19]

Williams

[11] 4,192,026

[45] Mar. 11, 1980

[54] DRAIN VALVE BALL LEVER

[75] Inventor: Frank N. Williams, Sandwich, Ill.

[73] Assignee: Bradley Corporation, Menomonee Falls, Wis.

[21] Appl. No.: 960,400

[22] Filed: Nov. 13, 1978

[51] Int. Cl.[2] ..... E03C 1/22

[52] U.S. Cl. ..... 4/203; 4/206; 403/289; 403/354

[58] Field of Search ..... 4/203, 204, 205, 206; 403/354, 375, 69, 70, 289

[56] References Cited

U.S. PATENT DOCUMENTS

| | | | |
|---|---|---|---|
| 1,469,493 | 10/1923 | Brown | 403/289 |
| 3,169,254 | 2/1965 | Lantz et al. | 4/203 |
| 3,353,192 | 11/1967 | Christiansan | 4/203 |
| 3,419,919 | 1/1969 | Stayner | 4/203 |
| 3,611,510 | 10/1971 | Bennett et al. | 403/354 |
| 3,646,619 | 3/1972 | Rokitenetz | 4/203 |
| 3,731,326 | 5/1973 | Politz | 4/203 |

*Primary Examiner*—Henry K. Artis

[57] ABSTRACT

A pop-up drain valve assembly for a sink includes a drain plug and control means for raising and lowering the plug to open and close the drain. The control means includes a manually operable plunger rod and a unitary, one piece, plastic ball lever that pivots to translate the downward force applied to the plunger rod into an upward force for lifting the drain plug to open the drain. The inner end of the ball lever is positioned beneath the drain plug and the outer end extends through and is retained in an opening in the plunger rod. The ball lever also includes an integral stop which prevents the rod from riding up and binding on the lever and retaining means which prevents the outer end of the lever from sliding out of the opening in the rod. In a preferred form, the retaining means is a pair of spaced apart, resilient fingers which can be forced together to permit the outer end of the lever to enter the opening of the rod and which upon release will resume their normal shape to prevent the outer end of the lever from being removed from the opening in the rod.

3 Claims, 4 Drawing Figures

DRAIN VALVE BALL LEVER

This invention relates to a pop-up drain valve assembly and, more particularly, to a unitary, one-piece, plastic ball lever for use as part of the control means for the valve assembly.

BACKGROUND OF THE INVENTION

Plumbing fixtures such as sinks that have faucets for supplying water, conventionally use a pop-up type drain valve assembly for controlling the flow of water through the drain. This type of assembly is provided with a manually operable control mechanism for raising and lowering a drain plug to open and close the drain. The control mechanism is normally comprised of a plunger rod connected to a ball lever which pivots on a fulcrum to translate the downward force applied to the plunger rod into an upward force for lifting the drain plug and opening the drain. When an upward force is applied to the plunger rod, the ball lever pivots in the opposite direction to allow the drain plug to drop by means of gravity to close the drain.

The prior art has provided a number of different arrangements for pop-up type drain valve assemblies. One such arrangement is disclosed in U.S. Pat. No. 3,731,326 issued to Politz on May 8, 1973. Politz discloses a ball lever having a plastic cover and ball member seated on one end of the rod 21 that prevents corrosion.

Another arrangement is disclosed in U.S. Pat No. 3,419,919 issued to Stayner on Jan. 7, 1969. Stayner discloses a plastic hinged ball lever which is connected by means of a set screw to a plunger rod that extends through a transverse bore in the lever.

SUMMARY OF THE INVENTION

The present invention relates to an improved ball lever for use as a part of a control means for manually opening and closing a drain plug in a pop-up drain valve assembly. More specifically, the invention resides in a unitary, one-piece, plastic lever having a ball integrally formed thereon, and a means for connecting the lever to a plunger rod of the control means. The connection is accomplished by providing the outer end of the lever with a section which is adapted to extend through an opening in the plunger rod. An integral stop for preventing the rod from riding up and binding on the arm of the lever is positioned intermediate the length of the arm. The lever also has retaining means for preventing the outer end of the lever from sliding out of the opening in the rod once inserted.

In a preferred form, the outer end of the ball lever is bifurcated and presents a pair of spaced, resilient tapered fingers. As the spaced, tapered fingers are inserted into the opening in the rod, they are forced together to reduce their effective diameter and to allow the outer end of the lever to pass through the opening in the rod and to snap in place. The stop which is preferably an integral flange prevents the rod from riding up and binding on the lever.

It is an object of the invention to provide an improved ball lever for a pop-up type drain valve assembly.

It is another object of the invention to provide an improved means for connecting a ball lever to a plunger rod in a pop-up type drain valve assembly.

The foregoing and other objects and advantages of the invention will appear from the following description. In the description, reference is made to the accompanying drawings which form a part hereof, and in which there is shown by way of illustration and not of limitation preferred embodiments of the invention. Such embodiments do not represent the full scope of the invention, but rather the invention may be employed in many other embodiments, and reference is made to the claims herein for interpreting the breadth of the invention.

DESCRIPTION OF THE PREFERRED EMBODIMENTS

Figure 1:
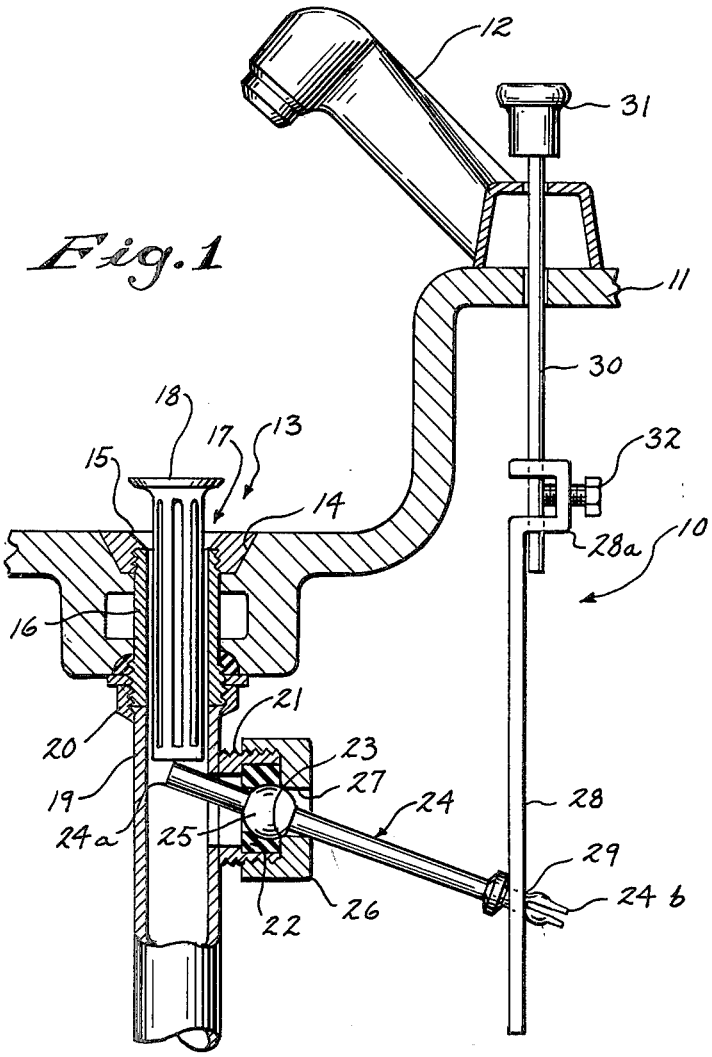
FIG. 1 is a fragmentary side view, partly in section, showing a pop-up type drain valve assembly employing a ball lever of the present invention.

Referring to FIG. 1, there is shown a pop-up type drain valve assembly designated generally by the numeral 10 for a wash basin or sink 11 having a faucet 12 for supplying water therein. The sink 11 has an outlet portion 13 in which there is provided a generally cylindrical, vertical opening 14. Mounted in the outlet portion 13 at the upper end of the opening 14 is an annular seat 15 which is threadedly engaged with a pipe 16. The opening 14, the annular seat 15 and the pipe 16 define the drain 17 which receives water from the sink 11. Disposed within the drain 17 is an elongated, fluted drain plug 18 normally seated by gravity against the seat 15. The pipe 16 extends below the outlet portion 13 of the sink 11 to threadedly engage a pipe extension 19 by means of a pipe union 20. The pipe extension 19 is provided with a horizontally extending fitting 21 having a washer 22 seated therein which forms a generally cylindrical ball socket 23.

The drain valve assembly 10 further includes an control mechanism for controlling the position of the drain plug 18, the present invention being a part of such mechanism. Extending into the lumen of the pipe extension 19 under and against the lower end of the drain plug 18 is one end of a unitary, one-piece, plastic ball lever 24. The ball lever 24 is an elongated, rod-like member having a ball 25 integrally formed thereon intermediate its length and toward its inner end **24*a*. The ball 25 is pivotally mounted in the socket 23 by means of a collar 26 threadedly engaged with the fitting 21, which permits pivotal movement of the lever 24. The collar 26 has an opening 27 formed in its outward face through which extends the arm of the lever 24. The arm of the lever 24 preferably tapers away from the ball 25 in order to facilitate molding. The lever 24 is connected at its outer end 24*b* to a plunger rod 28 at connection point 29. The plunger rod 28 which extends vertically upward from the connection point 29 to a U-shaped end portion 28*a* has an opening through which a manually operable lift rod 30 extends. The lift rod 30 has a knob 31 at its upper end and extends vertically through the body of the faucet 12** to be connected at its lower end in the U-shaped end portion 28*a* of the rod 28 by a set screw 32. Thus, by raising and lowering the knob 31 the ball lever 24 will pivot in the socket 23 to raise and lower the drain plug 18, as is conventionally understood by those skilled in the art.

Figure 2:
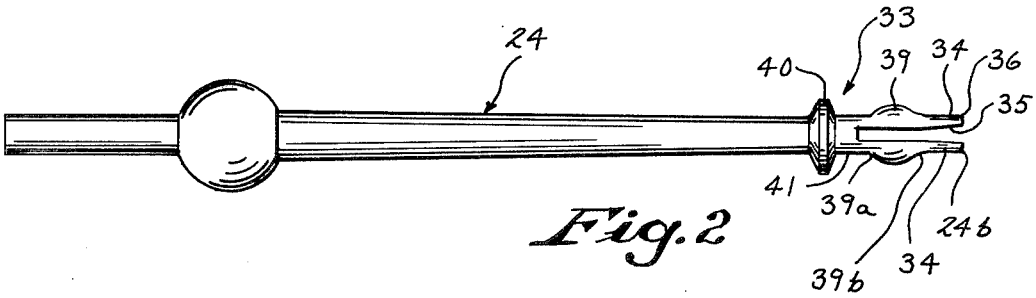
FIG. 2 is a side view in elevation of a ball lever constituting a first embodiment of the present invention.

FIG. 2 shows a first embodiment of the ball lever 24, and in particular, shows a detailed view of a connecting portion 33 of the outer end 24*b* of the ball lever 24. The connecting portion 33 projects outwardly and coaxially from the lever 24 and it is bifurcated or forked to present a pair of opposing, finger-like members 34 separated by a tapered slot 35. The finger-like members 34 are resilient so that when they are forcibly deformed toward each other, they will not set in that condition, but will spring back to their original shape and position upon release of the force.

Figure 3:
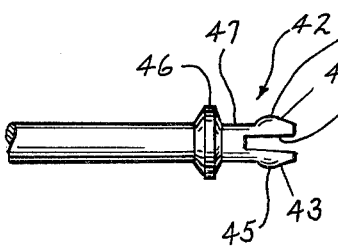
FIG. 3 is a fragmentary side view in elevation illustrating an alternate ball lever construction constituting a second embodiment of the invention.

As seen in FIGS. 1, 2 and 3, the members 34 have tapered tips 36. The tips 36 provide an easy lead-in into the plunger rod opening 38 (seen only in FIG. 4). Each finger-like member also has a rounded protuberance or knuckle 39 intermediate its length. These knuckles 39 are preferably integrally formed on the finger-like members 36, and convex in shape. The knuckles 39 have an apex and are tapered both inwardly 39*a* and outwardly 39*b* therefrom with the outward inclination toward the tip 36 being more gradual. The knuckles 39 have sufficient height so that the diameter as measured from the apex of one knuckle to the apex of the other is greater than the diameter of the plunger rod opening 38. A stop 40 in the form of an integral flange is spaced inwardly from the knuckle 39 to provide a rod-receiving annular groove 41 which is of lesser diameter than both the non-deformed diameter of the knuckles 39 and the stop 40. The diameter of the stop or flange 40 is greater than that of the opening 38 so that once the rod is in place in the groove 41 it is prevented from riding up and binding on the lever 24.

The connection of the ball lever 24 to the plunger rod 28 is made by inserting the tips 36 of the finger-like members 34 through an opening 38 in the lower end of the plunger rod 28 until the protuberances or knuckles 39 contact the edges of the opening 38. An additional pushing force then is exerted in the direction of the opening 38 so that the unyielding opening 38 forces the tapered, finger-like members 34 together to reduce the effective diameter of the knuckles 39 to less than that of the opening 38. When this occurs, the knuckles 39 pass through the opening 38 and the rod is in the annular groove 41. In actual operation, the process is accomplished so quickly that the ball lever 24 can be considered to be snapped into proper connection with the rod 28. The flange 40 prevents the rod 28 from leaving the groove 41 and riding up and binding on the outer end of the lever 24, and the steeper trailing edge or inward inclination 39*b* of the knuckles 39 prevent the ball lever 24 from sliding out of the opening 38 in the rod 28. The ball lever 24, may, if desired, be removed from the groove 41 by forcibly deforming the fingers 34 toward each other and into the slot 35 to reduce the effective diameter of the knuckles 39 to less than that of the opening 38.

Figure 4:
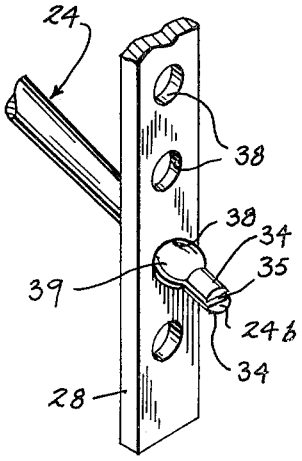
FIG. 4 is a fragmentary view in perspective illustrating the connection of the ball lever of FIG. 2 to a plunger rod of the drain valve assembly of FIG. 1.

It should be noted that FIG. 4 shows several vertically aligned openings 38 in the lower end of the plunger rod 28. These additional openings 38 are provided to allow adjustment of the raising and lowering stroke of the ball lever 24 so that sinks of different designs and depths may be accommodated.

In FIG. 3, there is shown a second embodiment of the invention in which the connecting portion 42 of the ball lever does not have the elongated, tapered tips 36 of the first embodiment. In this embodiment, the connecting portion 42 is also bifurcated or forked to present spaced, opposing, finger-like members 43. The ends of the finger-like members 43 are tapered and spaced apart by a slot 44 which allows sufficient deformation of the fingers 43 for a snap-in action to occur. The fingers 43 have protuberances or knuckles 45 similar to those of the first embodiment, and a flange 46 which with the knuckles 45 forms the rod-receiving annular groove 47 for the plunger rod 28. The connecting portion 42 of the second embodiment of the ball lever 24 is introduced into the opening 38 in the plunger rod 28 in the same manner as the first embodiment. However, since the more tapered tips 36 of the first embodiment provide a better lead-in for the connecting portion it is the preferred embodiment.

The ball rod lever is preferably molded of a plastic available from Celanese Corp. under the name Celcon. It is an acetal copolymer which possesses an inherent lubricity which facilitates the introduction of the fingers into the rod opening. In addition, it can withstand long exposure to elevated temperatures. Celcon is non-corrosive even when exposed to hot water and will not lime up. In addition to the aforementioned plastic, a wide variety of other plastic materials including nylon can be used which possess the properties needed to meet the requirements for the ball lever under conditions of use.

While in the embodiments shown and described the protuberances or knuckles 39 and 43 are integrally formed on the connecting portions various modifications are obviously possible without departing from the full scope and spirit of the invention. If desired, the functional equivalent of the knuckles may be provided by other means such as a retaining ring seated in a circular groove in the lever arm. Therefore, where the term "knuckle" is used in the specification and claims, it is intended that the functional equivalents to the illustrated and described structure are also intended to be covered. In view, of the possible modifications, the invention is not intended to be limited by the showing or description herein, or in any other manner, except insofar as may specifically be required.

I claim:

1. An improved ball lever for a pop-up drain valve assembly of the type in which an inner end of the ball lever is used to raise and lower the drain plug and the outer end is connected to a plunger rod, said improved ball lever comprising:

a unitary, one-piece, plastic, elongated member;

a ball integrally formed on said member intermediate its length upon which the inner end of said member pivots to raise and lower said drain plug; and an outer end which is adapted to extend into and through an opening in said plunger rod to form a releasable connection therewith, said outer end being provided with stop means which prevents said plunger rod from travelling along and binding on said elongated member and retaining means for releasably securing the outer end of said member in the opening in said plunger rod which is spaced from said stop means to provide a plunger rod-receiving groove, said retaining means comprising:

at least two outwardly extending, spaced apart, resilient fingers formed in the outer end of said elongated member; and an integral protuberance on each of said fingers having a combined non-deformed diameter which is greater than the diameter of the opening in said plunger rod but which is less than the diameter of the opening in said rod when said fingers are deformed by forcing them towards each other, each of said protuberances including an outward inclination which facilitates the insertion of the outer end of said elongated member into the opening in said plunger rod, and an inward inclination which prevents said outer end from sliding out of the opening in said plunger rod when said outer end is inserted into the opening in said rod, but which is sufficiently tapered to permit the outer end of said elongated member to be removed from said opening upon the application of sufficient force to deform said fingers to reduce the effective diameter of said protuberances to less than that of said opening.

2. The ball lever of claim 1 in which the stop means is an integral flange having a greater diameter than the opening in the plunger rod.

3. The ball lever of claim 1 in which the retaining means comprises two opposed fingers formed in the outer end of the elongated member.

* * * * *